US008274443B2

(12) United States Patent
Hauhe et al.

(10) Patent No.: US 8,274,443 B2
(45) Date of Patent: Sep. 25, 2012

(54) LIGHT WEIGHT STOWABLE PHASED ARRAY LENS ANTENNA ASSEMBLY

(75) Inventors: Mark Hauhe, Hermosa Beach, CA (US); Clifton Quan, Arcadia, CA (US); Gregg M. Tanakaya, Torrance, CA (US); Rohn Sauer, Encino, CA (US); Fangchou Yang, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 546 days.

(21) Appl. No.: 12/405,135

(22) Filed: Mar. 16, 2009

(65) Prior Publication Data

US 2010/0231479 A1 Sep. 16, 2010

(51) Int. Cl.
*H01Q 21/00* (2006.01)
*H01Q 9/16* (2006.01)
*H01Q 1/08* (2006.01)

(52) U.S. Cl. ..... 343/810; 343/793; 343/881

(58) Field of Classification Search ..... 343/879, 343/880, 881, 793, 810, 915, 824, 826, 753
See application file for complete search history.

(56) References Cited

U.S. PATENT DOCUMENTS 3,495,250 A * 2/1970 Yee George et al. ..... 343/834
3,755,815 A 8/1973 Stangel et al.
3,886,547 A 5/1975 Bottenberg
4,580,140 A 4/1986 Cheston
5,777,582 A * 7/1998 Raab ..... 343/700 MS
5,990,851 A * 11/1999 Henderson et al. ..... 343/915
6,421,021 B1 7/2002 Rupp et al.
6,650,304 B2 * 11/2003 Lee et al. ..... 343/915
6,674,340 B2 1/2004 Quan et al.
7,336,232 B1 2/2008 Lee et al.
2006/0033674 A1 2/2006 Essig, Jr. et al.
2007/0046547 A1 * 3/2007 Crouch ..... 343/700 MS
2008/0030413 A1 * 2/2008 Lee et al. ..... 343/705

OTHER PUBLICATIONS

Fang, et al., "Inflatable Structure for a Three-Meter Reflectarray Antenna," Journal of Spacecraft and Rockets, vol. 41, No. 4, Jul.-Aug. 2004 (pp. 543-550).
European Search Report for European Application No. 10250444.6-2220, European Search Report dated Aug. 10, 2010 and mailed Aug. 20, 2010 (6 pgs.).

(Continued)

*Primary Examiner* — Douglas W Owens
*Assistant Examiner* — Jennifer F Hu
(74) *Attorney, Agent, or Firm* — Christie, Parker & Hale, LLP

(57) ABSTRACT

A light weight stowable antenna lens array assembly is provided. In one embodiment, the invention relates to a stowable lens antenna array including at least one antenna pair including a transmit antenna on a first layered composite, a receive antenna on a second layered composite, a ground plane on a third layered composite, the ground plane being between and spaced apart from the transmit antenna and the receive antenna, and a balanced transmission line coupling the transmit antenna to the receive antenna, and an articulating structure attached to at least one of the first layered composite, the second layered composite and the third layered composite, the articulating structure having a collapsed configuration and an expanded configuration, wherein at least one of the first layered composite, the second layered composite and the third layered composite includes a polymeric film.

25 Claims, 8 Drawing Sheets

OTHER PUBLICATIONS

Chu, Ruey-Shi et al., "A Network Model of a Feedthrough Phased Array Lens of Printed Dipole Elements", IEEE, Dec. 1986, vol. AP-34, No. 12, pp. 1410-1417.
Hollung, Stein et al., "A Bi-Directional Active Lens Antenna Array", IEEE, 1997, pp. 26-29.
Rao, J. B. L. et al, "Two Low-Cost Phased Arrays", IEEE 1996, pp. 119-124.
Schwartzman, Leon et al., "Analysis of Phased Array Lenses", IEEE Transactions on Antennas and Propagation, vol. Ap-16, No. 6, Nov. 1968, pp. 628-632.

* cited by examiner

Stage 1: Completely Expanded

Stage 2: Contracting

Stage 3: Contracting

Stage 4: Contracted

Stage 2: Contracting

Stage 4: Contracted

Stage 1: Completely Expanded

Stage 3: Contracting

LIGHT WEIGHT STOWABLE PHASED ARRAY LENS ANTENNA ASSEMBLY

CROSS-REFERENCE TO RELATED APPLICATION

The present invention is related to U.S. patent application, entitled "Switchable 0°/180° Phase Shifter On Flexible Coplanar Strip Transmission Line", filed concurrently herewith, the entire content of which is incorporated herein by reference.

BACKGROUND

1. Field of the Invention

The present invention relates to the field of antennas and, more particularly, to a light weight stowable phased array lens antenna assembly.

2. Description of Related Art

Phased array lens antennas are used in radar and communication systems. In radar applications, phased array systems use electromagnetic waves to identify the range, altitude, direction, or speed of both moving and fixed objects such as aircraft, ships, motor vehicles, weather formations, and terrain. Phased array antennas are typically electrically steerable. Thus, unlike mechanical arrays, phased arrays are capable of steering the electromagnetic waves without physical movement. As phased array antennas do not require systems for antenna movement, they are less complex (no moving parts), are more reliable, and require less maintenance than their mechanical counterparts. Other advantages over mechanically scanned arrays include a fast scanning rate, substantially higher range, ability to track and engage a large number of targets, low probability of intercept, ability to function as a radio/jammer, and simultaneous air and ground modes.

Phased array lens antennas have been built with various printed circuit boards (PCB) or machined metal waveguide structures which are bulky, heavy and rigid. Alternatives such as reflector antennas made of light weight graphic composites supporting thin metalized films have been used in an attempt to work around the weight and rigidity problems but they become rigid upon deployment and do not retract. Therefore, a need exists for a light weight flexible scalable phased array lens assembly that can retract and collapse into a small volume for stowage and can be expanded at a different deployment location and time.

SUMMARY OF THE INVENTION

In accordance with the present invention, embodiments of an ultra-light weight lens antenna arrays are provided which can be stowed in a small volume for transport and expanded to large areas (e.g., tens of square yards) of aperture upon deployment. The ultra light weight (e.g., less than 1 Kg per square yard) physically flexible lens antennas can be used for reusable deployment and stowage in a space and near-space environment. The present invention sets a new standard in the state of the art in providing embodiments of flexible lens antennas that retract and collapse back into their original small volumes for restowage and that can be expanded again at different deployment locations and times.

Embodiments of the lens antennas include a foldable microwave lens construction that is simple, extremely light weight, and consists of three separate ultra-thin flex circuit layers connected with an RF flex interconnect. A thin flexible phase shifter can be readily integrated within the RF flex interconnect. Some embodiments make use of large area manufacturing processes used for the commercial marine sail industry.

In one embodiment, the invention relates to a layered composite for a microwave transmit/receive lens antenna pair, the composite including a first outer layer including a polymeric film, a second outer layer including a polymeric film, a middle layer disposed between the first outer layer and the second outer layer, the middle layer including a patterned reinforcing material, a first adhesive layer disposed between the first outer layer and the middle layer, and a second adhesive layer disposed between the middle layer and the second outer layer.

In another embodiment, the invention relates to a lens antenna array including at least one antenna pair including a transmit antenna on a first layered composite, a receive antenna on a second layered composite, a ground plane on a third layered composite, the ground plane disposed between, and spaced apart from, the transmit antenna and the receive antenna, and a balanced transmission line coupling the transmit antenna to the receive antenna, wherein at least one of the first layered composite, the second layered composite and the third layered composite includes a first outer layer including a polymeric film, a second outer layer including a polymeric film, a middle layer disposed between the first outer layer and the second outer layer, the middle layer including a patterned reinforcing material, a first adhesive layer disposed between the first outer layer and the middle layer, and a second adhesive layer disposed between the middle layer and the second outer layer.

In yet another embodiment, the invention relates to a stowable lens antenna array including at least one antenna pair including a transmit antenna on a first layered composite, a receive antenna on a second layered composite, a ground plane on a third layered composite, the ground plane being between and spaced apart from the transmit antenna and the receive antenna, and a balanced transmission line coupling the transmit antenna to the receive antenna, and an articulating structure attached to at least one of the first layered composite, the second layered composite and the third layered composite, the articulating structure having a collapsed configuration and an expanded configuration, wherein at least one of the first layered composite, the second layered composite and the third layered composite includes a first outer layer including a polymeric film, a second outer layer including a polymeric film, a middle layer disposed between the first outer layer and the second outer layer, the middle layer including a patterned reinforcing material, a first adhesive layer disposed between the first outer layer and the middle layer, and a second adhesive layer disposed between the middle layer and the second outer layer.

DETAILED DESCRIPTION

Figure 1:
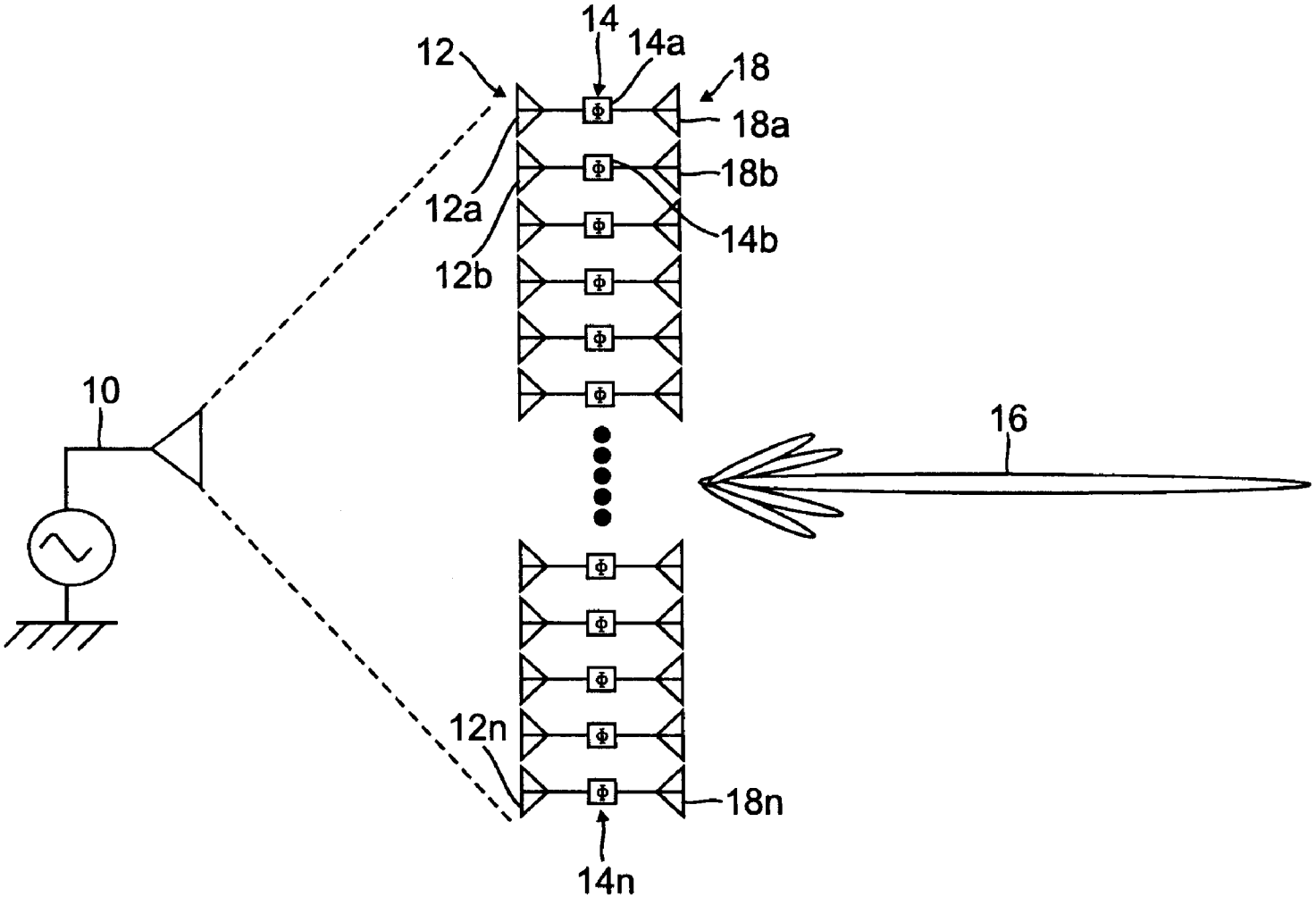
FIG. 1 is a schematic block diagram of a stowable phased array lens antenna having a plurality of dipole antenna elements in accordance with one embodiment of the present invention.

Referring now to the drawings, embodiments of stowable phased array lens antennas include a flexible layered composite antenna coupled to an articulating structure that can be expanded for use as a phased array and collapsed for easy storage and re-deployment. The lens antennas include multiple layers of a flexible composite material. In many embodiments, the multiple layers include a transmit antenna on one composite layer, a receive antenna on another composite layer and a ground plane on a third composite layer disposed between the transmit and receive antenna layers. In many embodiments, the flexible composite material includes two outer polymeric films (e.g., one for a transmit antenna and one for a receive antenna) that sandwich a patterned reinforcing layer, where the layered composite forms multiple antenna pairs for the lens antenna. Balanced transmission lines can couple dipole radiating elements on each of the receive antenna layer and the transmit antenna layer.

Embodiments of the articulating support structure are coupled to discrete sheets of the multiple layer composites that form the lens antennas such that when the structure is deployed, it causes the discrete sheets of the multi-layered lens antennas to be pulled flat. When the articulating structures are retracted, or contracted, the multi-layered composite sheets are collapsed, or retracted by gravity, into a much smaller form than when deployed. In such case, the lens antenna arrays can be stowed and redeployed at other times or locations. The articulating support structure can operate similar to a pantograph.

Edges of the layered composites can include elongated sleeves for receiving tensioning cables. When the lens is deployed, the articulating structure can apply tension to the cables thereby making the multilayer composite sheets approximately flat. In some embodiments, the sheets include four edges having an arcuate shape for achieving an approximately flat surface during deployment of the lens antennas. In one embodiment, the sheet edges have a catenary shape for achieving an approximately flat surface during deployment of the lens antennas.

In a number of embodiments, the lens antennas are made of flexible lightweight materials capable of supporting antenna elements and capable of being stowed in a relatively small volume. In such case, the lens antenna can be easily stored and redeployed. In many embodiments, the lightweight materials include polymeric films such as Kapton®.

FIG. 1 is a schematic block diagram of a stowable phased array lens antenna having a plurality of dipole antenna elements in accordance with one embodiment of the present invention. The dipole antenna elements (12, 18) each include phase shifting switches 14 along balanced transmission lines that couple the antenna elements. The phase shifting switches are described in greater detail in co-pending U.S. Patent Application entitled "Switchable 0°/180° Phase Shifter On Flexible Coplanar Strip Transmission Line" filed concurrently herewith.

In the lens antenna illustrated in FIG. 1, a remote horn 10, or other radiating antenna, illuminates a first group of dipole antennas 12. Energy captured by the first group of dipole antennas 12 is fed by the balanced transmission lines, such as coplanar strip (CPS) transmission lines, to the phase shifters (e.g., phase shifting switches) 14 for processing before it is again fed by balanced transmission lines for transmitting a composite antenna beam 16 from a second group of dipole antennas 18.

In the embodiment illustrated in FIG. 1, radiators 12*a*, 12*b* . . . 12*n* form first group 12. Another group of radiators 18*a*, 18*b* . . . 18*n* form second group 18. Corresponding phase shifting switches 14*a*, 14*b*, . . . 14*n* are disposed between each respective transmit and receive radiators. The phase shifters, or phase shifting switches, are used to steer the composite antenna beam 16 resulting from the combination of transmit radiators. A phase front can be created or delayed on each element so that collectively the phase front tilts. In other embodiments, other configurations of dipole antennas, or other suitable antenna configurations, can be used.

Figures 2A, 2B, 2C:
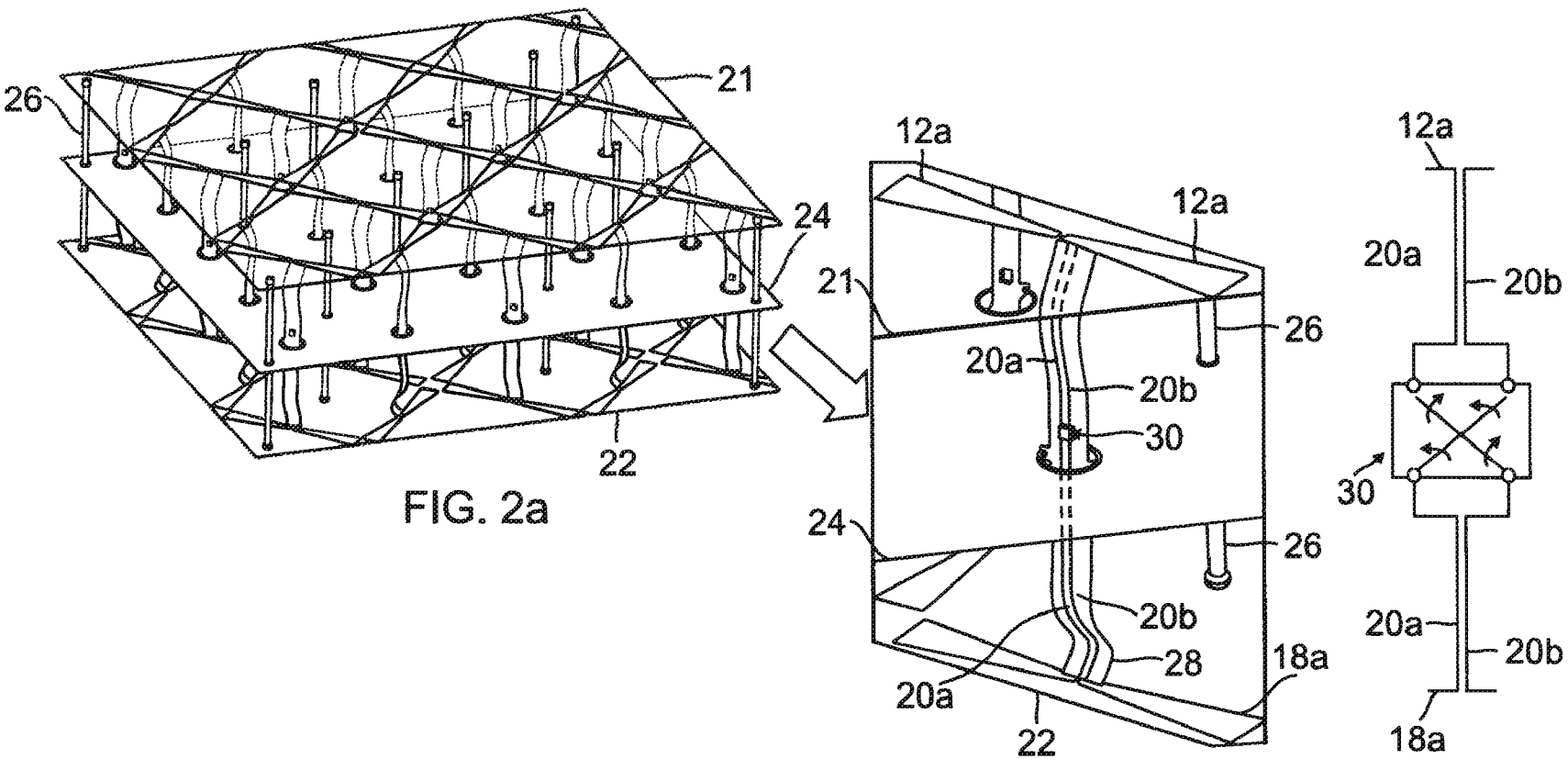
FIG. 2*a* is a perspective view of a portion of an antenna structure that can be used in conjunction with the stowable lens antenna of FIG. 1 in accordance with one embodiment of the present invention.
FIG. 2*b* is a perspective view of a portion of the antenna structure of FIG. 2*a* including a single transmit/receive dipole antenna pair coupled by a flexible coplanar strip (CPS) transmission line having a phase shifting switch in accordance with one embodiment of the present invention.
FIG. 2*c* is a schematic diagram of the dipole antenna pair and phase shifting switch of FIG. 2*b*.

FIG. 2*a* is a perspective view of a portion of an antenna structure that can be used in conjunction with the stowable lens antenna array of FIG. 1 in accordance with one embodiment of the present invention. The antenna structure includes a top layer 21 including a number of radiating elements, a middle layer 24 including a ground plane, and a bottom layer 22 including a number of radiating elements. The antenna structure further includes a number of dipole antenna pairs, where each pair includes a first radiating element on the top layer 21, a second radiating element on the bottom layer 22, and a flexible feed cable that couples the first radiating element to the second radiating element. The flexible cables also couple the radiating elements to conductors (not shown) routed on the middle layer 24. The top, middle and bottom layers are physically and electrically isolated using a plurality of graphite posts 26 disposed between the layers.

FIG. 2*b* is a perspective view of a portion of the antenna structure of FIG. 2*a* including a single transmit/receive dipole antenna pair coupled by a flexible coplanar strip (CPS) transmission line having a phase shifting switch in accordance with one embodiment of the present invention. Each of the radiating elements (12*a*, 18*a*) of the transmit/receive antenna pair is located on a separate layer or sheet (21, 22) with a ground plane sheet 24 disposed therebetween. The sheets (21, 22) are separated, both physically and electrically, from ground plane 24 by graphite posts 26. A balanced CPS transmission line 28, having conductors (20*a*, 20*b*), interconnects the transmit/receive antenna pair (12*a*, 18*a*) and includes phase shifter 14*a*.

Each of the sheets 21, 22, 24 can be made of multi-layer flexible materials (e.g., composite sheets), which have respective conductive dipole antenna patterns (12*a*, 18*a*) etched or screen printed thereon, and can be separated from ground plane sheet 24 by the graphite posts 26. The ground plane sheet 24 provides isolation between each of the antenna patterns. Once the composite sheets are laid out flat, the graphite posts 26 maintain the separation between the pair of antenna patterns. In the stowed position the antenna sheet assembly 25, which includes both of the pairs of antenna patterns, collapses.

FIG. 2*c* is a schematic diagram of the dipole antenna pair and phase shifting switch 30 of FIG. 2*b*. In some embodiments, the dipole antenna pair is one of the antenna pairs of the lens antenna of FIG. 1. In such case, each of the remaining pairs of the lens antenna can be similarly implemented to form the lens antenna in accordance with the present invention.

Figure 2D:
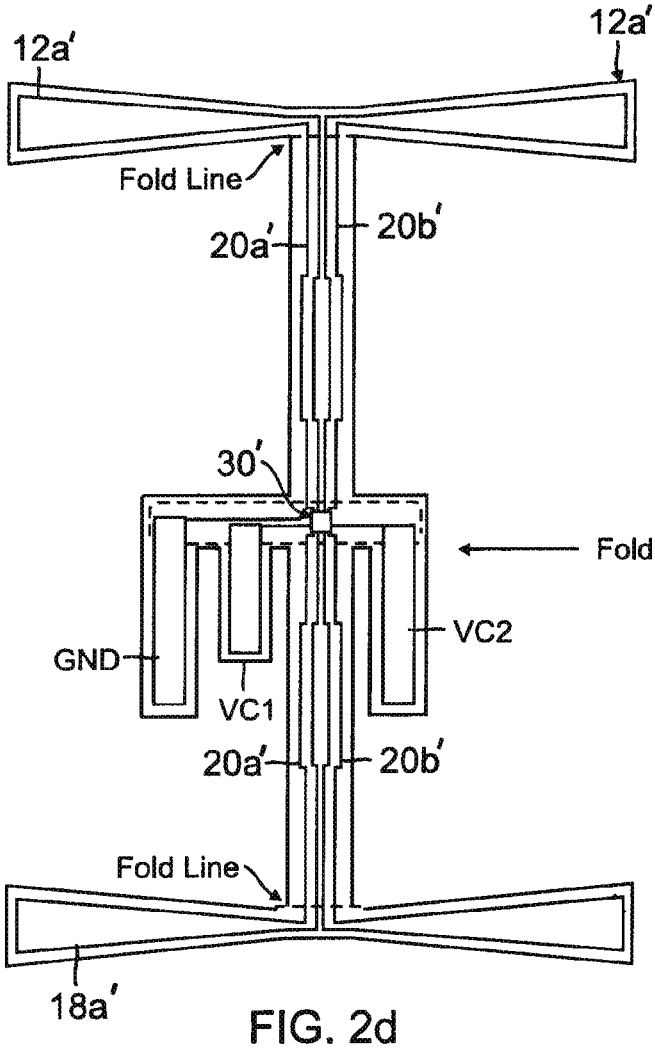
FIG. 2*d* is a top view of a single transmit/receive dipole antenna pair coupled by a flexible feed cable that can be used in conjunction with the antenna structures of FIG. 2*a* and FIG. 2*b*.

FIG. 2*d* is a top view of a single transmit/receive dipole antenna pair coupled by a flexible feed cable that can be used in conjunction with the antenna structures of FIG. 2*a* and FIG. 2*b*. The dipole antenna pair includes a first radiating element 12*a*' and a second radiating element 18*a*' coupled by conductors (20*a*', 20*b*') of the flexible feed cable. The flexible feed cable also includes a phase shifting switch 30' disposed approximately midway between the radiating elements (12*a*', 18*a*') along a top side of the flexible feed cable.

The flexible feed cable further includes a first flexible flap GND for coupling with a ground plane, a second flexible flap VC1 for coupling with a first switch control voltage, and a third flexible flap VC2 for coupling with a second switch control voltage. The flexible flaps can be folded or bent to make connections with various signals on the middle layer 24 of the antenna structure (see FIGS. 2*a* and 2*b*). In some embodiments, the middle layer 24 (see FIGS. 2*a* and 2*b*) has a ground plane on one side of the layer and control signals, such as the switch control signals, routed on the other side of the layer. The flexible flaps (GND, VC1, VC2) can be bent or folded in order to physically couple the phase shifting switch with appropriate connection points (not shown) on the middle layer.

Figure 2E:
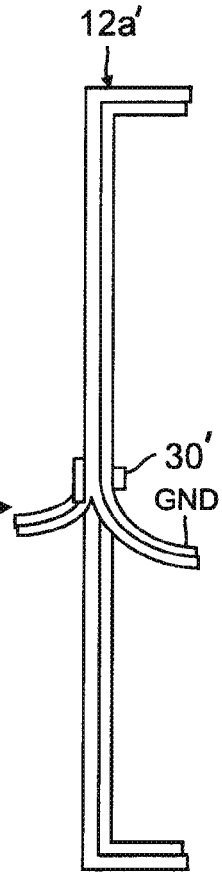
FIG. 2*e* is a side view of the single transmit/receive dipole antenna pair coupled by the flexible feed cable of FIG. 2*d*.

The radiating elements and conductors on the flexible feed cable can be formed of conductive metals that have been deposited or etched onto the cable. In many embodiments, the flexible feed cable is made of Kapton® film or another suitable flexible material for implementing electrical circuitry. FIG. 2*e* is a side view of the single transmit/receive dipole antenna pair coupled by the flexible feed cable of FIG. 2*d*.

Figure 3A:
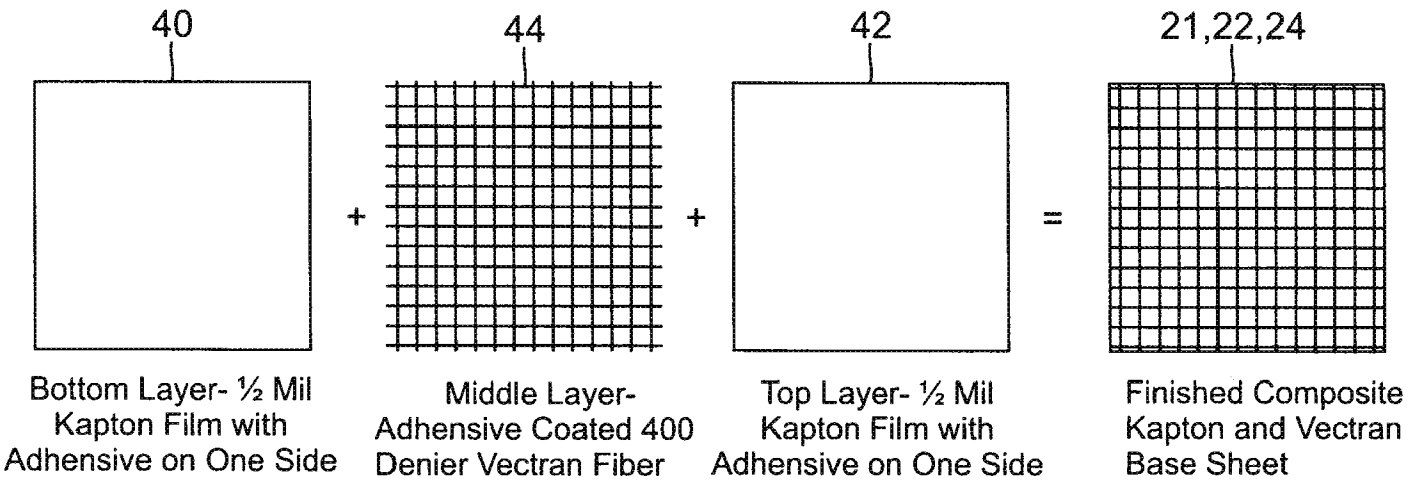
FIGS. 3*a* and 3*b* illustrate a composite layering structure for any one of the layers of the antenna structure of FIGS. 2*a* and 2*b* in accordance with one embodiment of the present invention.
Figure 3B:
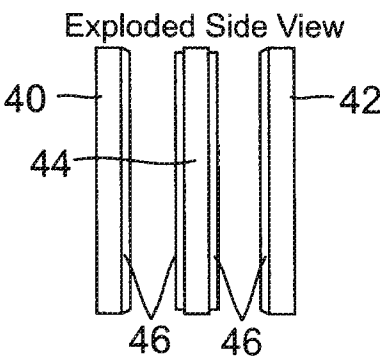

FIGS. 3*a* and 3*b* illustrate a composite layering structure for any one of the layers of the antenna structure of FIGS. 2*a* and 2*b* in accordance with one embodiment of the present invention. The multi-layer composite includes a 0.0005 inch thick polyimide film, such as Dupont's Kapton® film, on a bottom layer 40, another 0.0005 inch thick polyimide film, such Kapton® film, on a top layer 42 with a 0.0005 thick inch 400 Denier patterned aromatic polyester fiber, such as Vectran fiber, as a middle layer 44 sandwiched between the top layer 42 and the bottom layer 40. In other embodiments, the materials can have other thicknesses. Adhesive, such as Pyralux® adhesive made by Dupont, can be disposed on the surfaces of the bottom and top layers that face the middle layer and on both surfaces of the middle layer. These reinforced plastic sheets bond together to form a composite structure. In some embodiments, the adhesive is administered in sheet form.

The bottom and top layers of the multi-layer flexible material allow the transfer of sheer load through the sheets, hold the fiber layer in place, and provide a surface that can be plated or printed on. The fiber layer provides tensile strength and a rip stop in case the sheet is punctured and begins to tear. The completed reinforced plastic sheet is soft and can be folded easily. As such, each of the sheets is very thin, flexible, strong and not prone to tearing or stretching. In addition, the sheets can provide an excellent platform for an antenna pattern.

In the embodiments illustrated in FIGS. 3*a* and 3*b*, specific thicknesses for materials are indicated. In other embodiments, the materials can have smaller or larger thicknesses. In the embodiments illustrated in FIGS. 3*a* and 3*b*, specific materials are indicated. In other embodiments, other suitable materials can be used. In the embodiments illustrated in FIGS. 3*a* and 3*b*, adhesives are disposed on both sides of bonding surfaces. In other embodiments, adhesives are disposed only on one of the bonding surface, or are administered by other methods known in the art for bonding surfaces. In one embodiment, a single layer of kapton is bonded with a polyester fiber layer. In another embodiment, a single layer of kapton is used without a fiber layer.

Figure 4:
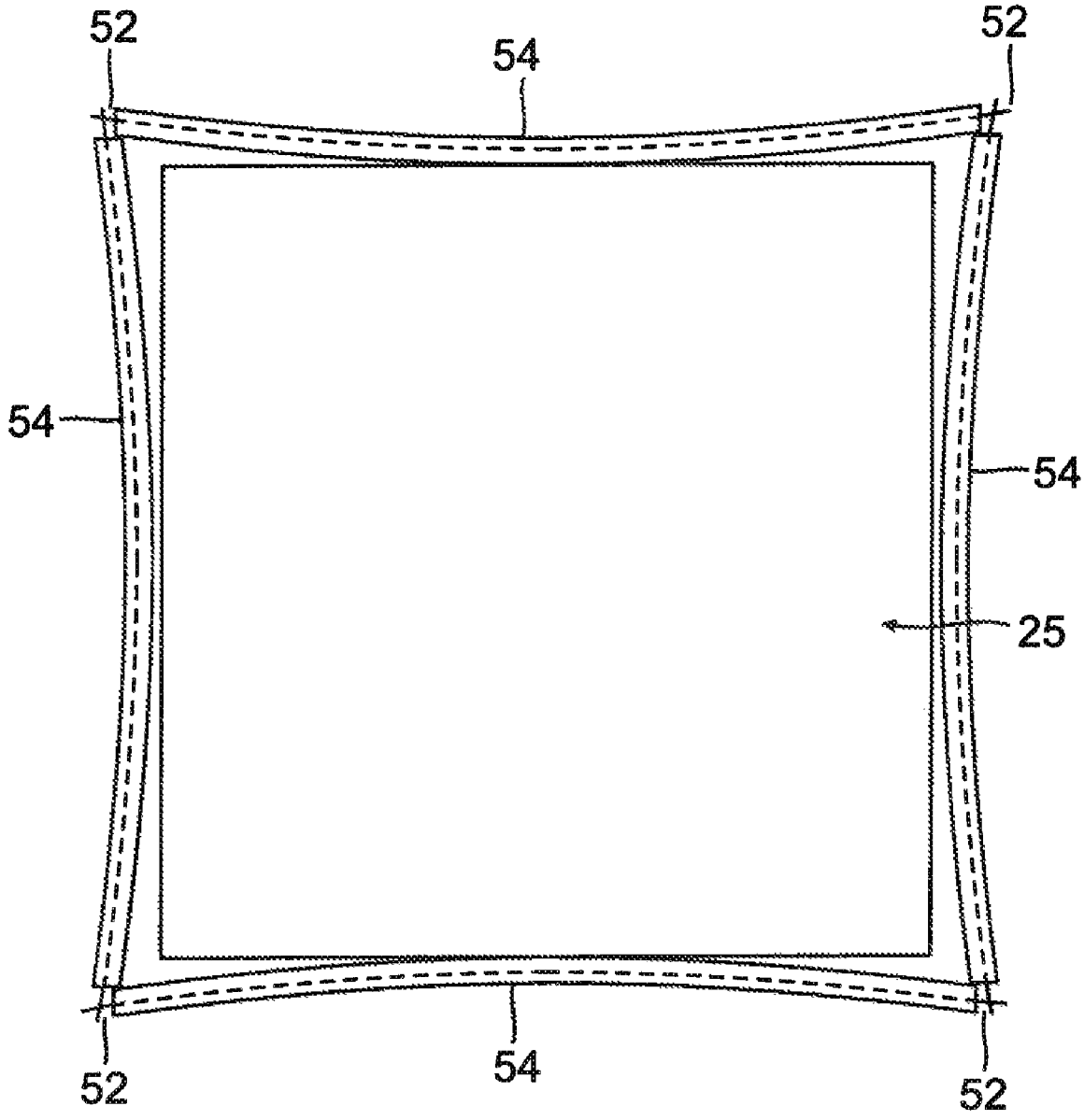
FIG. 4 illustrates a flat sheet of one or more of the composites of FIGS. 3*a* and 3*b* having tensioning cables installed in catenary sleeves along edges of the flat sheet in accordance with one embodiment of the present invention.
Figure 5A:
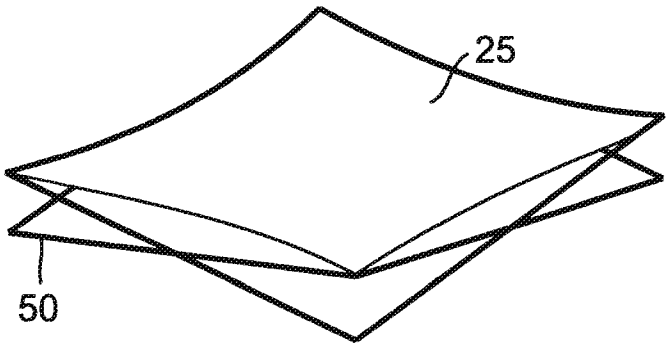
FIGS. 5*a*, 5*b*, 5*c* and 5*d* illustrate a composite sheet antenna mounted to an articulating structure in a sequence of stages from expansion to contraction in accordance with one embodiment of the present invention.
Figure 5B:
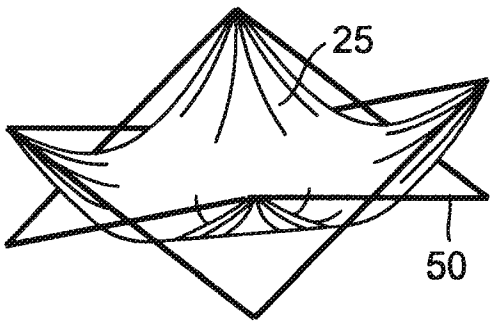
Figure 5C:
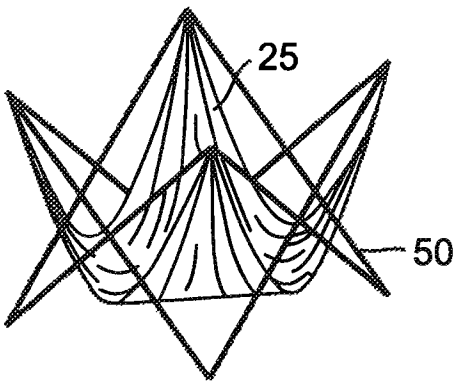
Figure 5D:
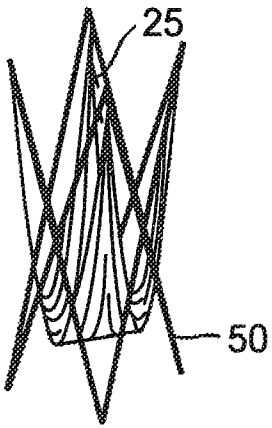
Figure 6B:
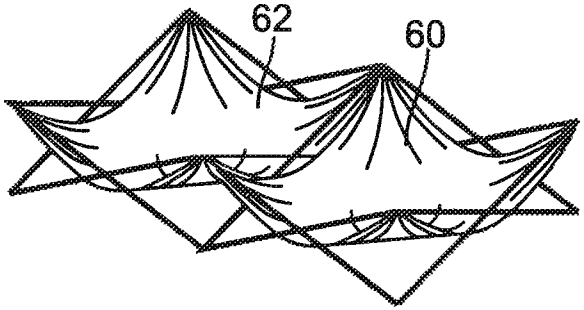
FIGS. 6*a*, 6*b*, 6*c* and 6*d* illustrate a composite sheet antenna having a pair of sheets mounted to an articulating structure in a sequence of stages from expansion to contraction for a pair of composite sheets in accordance with one embodiment of the present invention.
Figure 6D:
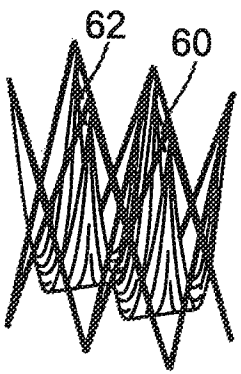
Figure 6A:
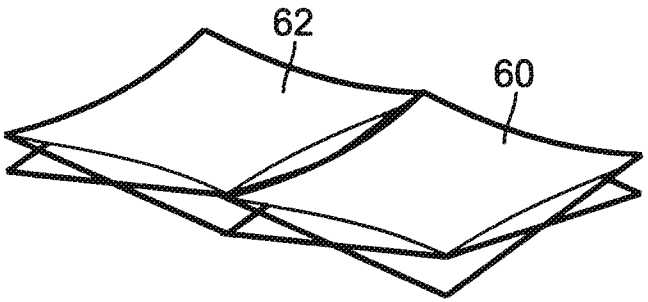
Figure 6C:
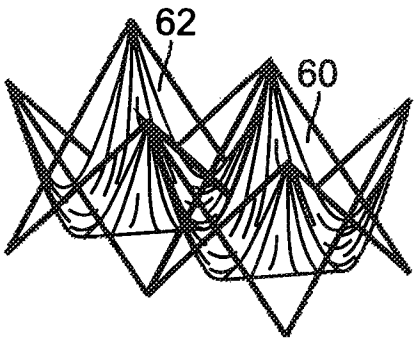

FIG. 4 illustrates a flat sheet of one or more of the composites of FIGS. 3*a* and 3*b* having tensioning cables installed in catenary sleeves along edges of the flat sheet in accordance with one embodiment of the present invention. Along each edge of the reinforced plastic sheet layers 21, 22, 24 (see FIGS. 2*a* and 2*b*) forming sheet assembly 25 are elongated pockets or sleeves formed along the edges to create the four concave catenary slots 54. The concave or arcuate edges take a catenary loading form that allows the sheet to be pulled tight without wrinkles or sagging. The catenary form is similar to the shape of suspension bridges having main cables draped along the length of the bridge. The cable is fed through the sleeve at a concave edge and pulled tight on four sides to suspend and flatten each reinforced plastic sheet. Because of certain structural advantages, the catenary form is often used on bridges with heavy chain or cable, slips, oil rigs and docks which must be anchored to the seabed.

The tension on the cables 52 can pull the layers 21, 22, 24 of the antenna sheet assembly 25 flat. The tension applied to the cables in the slots will determine how flat the sheet assembly will become. Environmental temperature and the natural expansion and contraction of the sheet will cause variation in the resistance to the force applied by the tensioned cables. The change in tension will cause the flatness of the sheet assembly to vary. Maintaining a consistent tension load on the cable at the edges of the sheet assembly will allow for the sheet to maintain a constant flatness through the changes in environmental conditions.

A constant tensioning system could be employed to maintain a consistent tension on the cable. In one such case, one end of each tensioning cable could be secured to a hard mount and the other end would be connected to a constant tensioning system or the tensioning system could be built directly into the cable. Those skilled in the art can appreciate that there are several methods to apply constant tension to a cable, including, but not limited to, weights, negator springs, and force feed back systems. Weights connected to the end of a cable would apply tension with constant gravity, but would not work in a dynamic environment or zero gravity (zero G) environment, such as space. The negator springs can apply constant tension over a large range of deflection similar to a common tape measure. A force feed back system would use a sensor to detect tension, and a driver motor to apply the appropriate load.

Referring now to FIGS. 4, 5*a*, 5*b*, 5*c* and 5*d*, the antenna sheet assembly 25 can be expanded to form a large flat sheet or collapsed a small bundle respectively. In an exemplary embodiment, the control of the expansion and contraction is provided by a pantograph structure or articulating structure 50 shown in FIGS. 5*a* to 5*d* going through four stages, that is, from completely expanded to contracted. This process of expansion and contraction can be repeated multiple times as needed. When the pantograph structure is collapsed, the antenna sheet assembly 25, which is affixed to opposing corners of the pantograph structure, will be pushed together. When the pantograph is opened, cables 52 fed through catenary slots 54 formed on each of the four edges of antenna sheet assembly 25 are pulled in tension. The tension on the cables will pull the sheet assembly flat. Once the pantograph or articulating structure is expanded, a constant tensioning system can be employed.

The pantograph structure 50 may be made of light weight tubes, such as aluminum or carbon fiber. In one exemplary embodiment, a number of tubes having a diameter of less than 1 inch and thickness of less than 0.125 inches can be used to build a pantograph that expands to an 8 foot by 8 foot structure. These tubes could be hinged in the center and at the ends to form the common pantograph structures seen in tents, collapsible chairs and collapsible tables. The pantograph or articulating structure could be pulled into place using cables and pulleys, motor and gears, or hydraulics. The articulating structure could be replaced by a hydraulic, an inflatable structure, or other structure configured to collapse and expand similar to a pantograph.

Those skilled in the art can appreciate that the single dipole antenna pair (12*a*, 18*a*) shown in FIG. 2*b* can be expanded to include an array of dipole antennas which get formed into the antenna sheet assembly 25. For example, in FIG. 2*a*, transmit/receive antenna pairs are adjacent to other transmit/receive antenna pairs such that their dipole elements are aligned in a particular direction. The number of antenna pairs can be increased in view of the desired antenna array electrical characteristics.

FIGS. 6*a*, 6*b*, 6*c* and 6*d* illustrate a composite sheet antenna having two sheets mounted to an articulating structure in a sequence of stages from expansion to contraction in accordance with one embodiment of the present invention. Further, those skilled in the art can appreciate that more than one antenna sheet assembly, whether having a single dipole transmit/receive pair as in FIG. 2*b*, or an array of dipole transmit/receive pairs as in FIG. 2*a*, can be attached together to form a multiple sheet assembly as in FIG. 6*a* to 6*d*. In FIGS. 6*a* to 6*d*, two exemplary sheet assemblies (60, 62) are illustrated as they pass from a completely expanded Stage 1 in FIG. 6*a*, through a contracting Stage 2 in FIG. 6*b*, through another contracting Stage 3 in FIG. 6*c*, to the fully contracted Stage 4 in FIG. 6*d*.

Unlike prior art antenna arrays, embodiments of the present invention may include a lens antenna that consists of two radiating membrane layers on either side of a common membrane containing a girded ground/signal plane. The lens can be divided up into bays such as the sheet assemblies 60, 62 and sized to minimize total mass, to permit a realizable articulating structure, to allow for desired flatness and ground spacing control for both zero and one G environments and to meet an integer multiple of $\lambda/2$ spacing at the desired frequency of operation. In an exemplary baseline system, dual polarized radiators are employed with 0 to 180 degrees phase shifting performed in free space by switching the dual polarized orthogonal elements from one side of the lens to the other.

In several embodiments, the ground and signals are routed on the center sheet of the antenna sheet assembly. The ground plane is realized with an etched copper lattice to reduce weight but densely spaced to provide isolation. The opposite side of the ground plane may be used for routing the signal lines that drive the phase shifting switches or diversity switches. These are easily etched into the ground plane sheet and generally carry only AC currents making them very thin with minimal mass.

An exemplary embodiment employs a dipole antenna which operates at a center frequency of 1.5 GHz. The dipoles may be arrayed in a small 16 element dual polarization sub array. Use of dipole antennas offers a profile with a reasonable bandwidth and minimal metal coverage thereby reducing the mass of the lens array. The dipole antenna can also be a twin lead fed, highly efficient antenna that provides dual linear polarization. The dipole antenna can be easily implemented using standard photolithography processes.

In the exemplary embodiments, the mechanical properties of the lens array are verified by 1 G electrical and mechanical ground validation testing, and additional testing involving membrane management during a minimum of 50 deploy/retract cycles and attachment to the structure while maintaining minimal mass and compatibility within the environment. In some embodiments, design goals such as low mass and compliancy for stowability drive use of thin materials and minimization of metallization and fasteners. The lens antennas may be built in bays on the order of 2 yards on a side. This size can minimize the number of interfaces between the pantograph structure and the lens itself. In an exemplary embodiment, two sizes of bays can be used for a fully deployed structure with partially active bays at the periphery of the lens. Each lens bay is autonomous of each other for installation on the pantograph structure. Use of four points of attachment (e.g., one at each corner of a bay) can minimize the attachment hardware.

In many embodiments, the lens membrane material achieves a 1 Kg per yard square area density. The polyimide has desirable functional properties as to coefficient of thermal expansion (CTE), elongation, creep, compatibility with space environment, manufacturability and other properties. In one exemplary embodiment, the thin 0.0005 inch thick polyimide film is commercially available in roll form. The film can have low loss at RF and can support fine line interconnects. The film material composite can be suitable for a space environment and has been successfully evaluated for total radiation dose and cold temperature soak.

Key practical properties of materials for use with embodiments of lens antennas include compatibility in the space environment, excellent tensile strength, good electrical characteristics and availability in large formats, such as, for example, 1000 foot rolls with sheets 24 inches wide. Polyimide is also compatible with many space qualified bonding materials and is available in a 0.0005 inch thick copper clad roll format. In order to achieve a minimum of 50 deploy and contract cycles, and to provide localized and distributed mechanical strength, a rip stop material can be bonded to each of the top and bottom layers. In several embodiments, the rip stop material is Vectran fiber. The rip stop material can be adhesively bonded to the polyimide and can be applied to large areas via a commercial process. The commercial process can be similar to that of the maritime sail industry where large sail materials are reinforced with Vectran fiber on large format bonding and curing processes. In some embodiments, a 10 yard square area can be accommodated where the adhesive and fibers are selectively place at the desired orientation and spacing. In such case, fiber spacing is on the order of 2 cm in a grid pattern with 400 Denier fiber. The mass of the fiber is on the order of 75 grams for a 17 square yard lens.

Second order effects include the CTE mismatch between the structure and the lens due in part to partial shading to full sun transmission across the lens and variation in stresses at the attach points. In order to mitigate these effects and to ensure reliable ground and launched operations, the catenary system can be provided for each bay of the lens. The catenary system is applied to each layer of the three layer lens structure to flatten each layer individually and the layer to layer spacing is controlled by posts. The system in accordance with the present invention can eliminate the need for inter-bay spacing structures or rods.

In exemplary embodiments, additional sheets could be included. For example, in addition to the top antenna sheet and the bottom antenna sheet separated by a ground plane therebetween, additional frequency selective surface sheets (FSS) can be located between the ground plane and the top antenna sheet and the ground plane and the bottom antenna sheet. Dipole antennas generally have a certain bandwidth in and of themselves which is particularly limited in front of a ground plane. As such, the FSS sheets, which are ground plane sheets with a series of holes thereon which resonate at certain frequencies and acts as a filter. The FSS can be located from the antenna array sheet at the wavelength divided by two, or $\lambda/2$, from the high end of the desired operating frequency band, while the ground plane can be located from the antenna array sheet at $\lambda/2$ from the low end of the desired operating frequency band.

Figure 7:
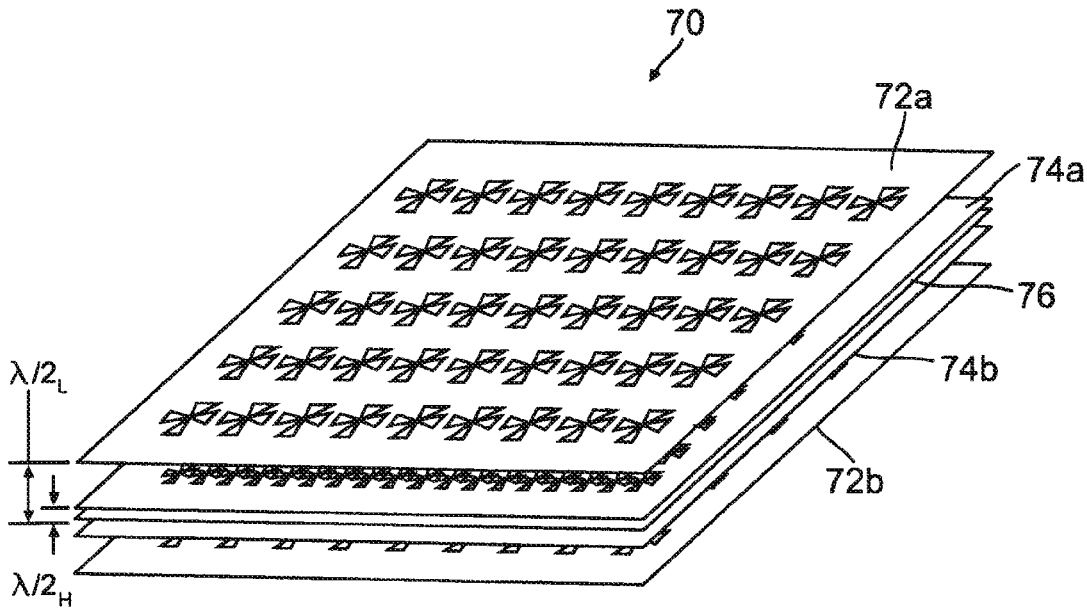
FIG. 7 illustrates an alternative antenna structure having additional layers inserted above and below a center ground plane in accordance with one embodiment of the present invention.

FIG. 7 illustrates an alternative antenna structure 70 having additional layers inserted above and below a center ground plane 76 in accordance with one embodiment of the present invention. The antenna structure (e.g., an L-band lens) 70 includes outer layers of low band dipoles (72*a*, 72*b*), the ground plane 76 disposed between the outer layers, and intermediate layers of high band dipoles (74*a*, 74*b*) disposed between the ground plane 76 and the outer layers (72*a*, 72*b*). The high band dipole layers (74*a*, 74*b*) can be one quarter wavelength away from the ground plane 76, for example, at the high band frequency center. In a number of embodiments, the layers are made of polyimide film.

The lattice spacing between high band dipoles can generally be tighter than the lattice spacing of the low band dipoles due to differences in high frequency performance of the dipoles. As such, there can be a higher density of high dipoles (along their associated interconnects) than low band dipoles across the panels. At the first glance of their respective element lattice spacing, this configuration can be designed so that there is little interference between the high band and low band dipoles as long as their respective operating frequencies are not integral multiples of each other. If the operating frequencies of respective dipoles are integral multiples of each other, additional components (e.g., fences) may be necessary to provide additional isolation between the dipoles. To direct antenna phase, two difference phase shifting switches tuned for each available band that can be used.

Figure 8:
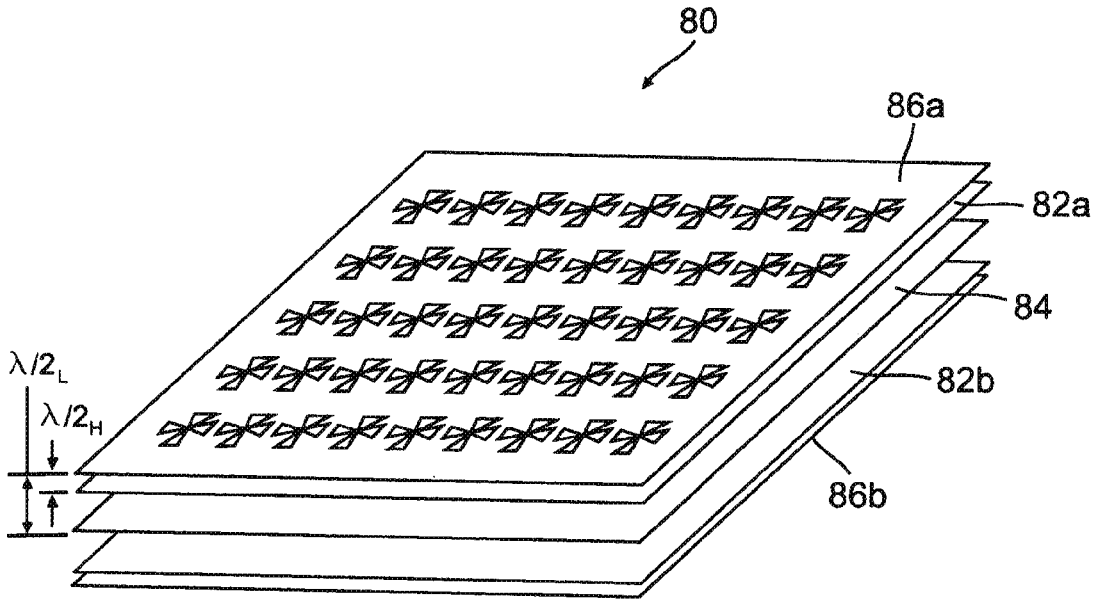
FIG. 8 illustrates another alternative antenna structure having additional layers including a frequency selective surface sheet (FSS) inserted above and below a center ground plane in accordance with one embodiment of the present invention.

FIG. 8 illustrates another alternative dual band dipole lens antenna structure 80, having additional layers including frequency selective surface sheets (FSS) inserted above and below the ground plane in accordance with one embodiment of the present invention. The antenna structure (e.g., an L-band lens) 80 includes frequency selective surface sheets (82*a*, 82*b*) inserted above and below the ground plane 84. The upper FSS is spaced below the upper dipole layer 86*a* such that it is $\lambda/2$ at the high frequency end, while the ground plane 84 is spaced below the upper dipoles such that it is $\lambda/2$ at the low frequency end. The lower FSS 82*b* is spaced above the lower dipole layer 86*b* such that it is $\lambda/2$ at the high frequency end, while the ground plane 84 is spaced above the lower dipoles such that it is $\lambda/2$ at the low frequency end.

The manufacturability of large area structures can be important to an affordable implementation. For processing the layered materials, which includes membrane to membrane seaming, epoxy dispense, fiber placement and curing can be performed at a commercial marine sail manufacturer which is capable of processing large contiguous sheets of materials including polyimides. The processing may be computer controlled throughout, eliminating any manual labor other than material lay up.

Assembly of the dipole patterns and switches can also use commercial high rate assembly techniques. Conductive and structural epoxies can be used to assemble the switch to the flexible dipole twin lead. In some cases, a simple DC control test is used prior to assembly onto the lens membrane. Individual assemblies simplify final assembly on the large area membrane, where each two yard bay can be assembled individually and then attached to the pantograph structure.

The present invention offers direct application to current, as well as future microwave systems. The flexible lens antennas in accordance with the present invention significantly improve upon current approaches by providing ultra light weight phased array panel antennas for space and near space based platforms. The present invention is particularly suited for today's environment where thinner, lighter and better performing mono-static and hi-static radar systems, as well as other sensors and support equipment are in demand. Embodiments are also particularly suited for providing thinner, lighter and better performing radar and communication systems operating at microwave frequencies, as well as other sensors, electronics and support equipment.

The present invention furthers the state of the art by providing a lens antenna that retracts and collapses back into an original small volume for stowage and can be expanded again at different deployment locations and times. The architecture of the lens can use a combination of commercially available materials and electronic components. Manufacturing processes for the present invention can leverage the large area manufacturing processes used for the commercial marine sail industry. Further, the materials and the architecture of the lens is amenable to higher frequency operation such as at Ku Band frequencies.

Although the present invention has been described with reference to the exemplary embodiments thereof, it will be appreciated by those skilled in the art that it is possible to modify and change the present invention in various ways without departing from the spirit and scope of the present invention as set forth in the following claims.

What is claimed is:

1. A lens antenna array comprising:

at least one antenna pair comprising:

a transmit antenna on a first layered composite;

a receive antenna on a second layered composite;

a ground plane on a third layered composite, the ground plane disposed between, and spaced apart from, the transmit antenna and the receive antenna; and a balanced transmission line coupling the transmit antenna to the receive antenna the balanced transmission line on a fourth layered composite;

wherein at least one of the first layered composite, the second layered composite and the third layered composite comprises:

a first outer layer comprised of a polymeric film;

a second outer layer comprised of a polymeric film;

a middle layer disposed between the first outer layer and the second outer layer, the middle layer comprising a patterned reinforcing material;

a first adhesive layer disposed between the first outer layer and the middle layer; and a second adhesive layer disposed between the middle layer and the second outer layer.

2. The lens antenna array of claim 1, further comprising a phase shifter disposed along the balanced transmission line.

3. The lens antenna array of claim 1, wherein the transmit antenna and the receive antenna are components of a dipole antenna having an operating center frequency of approximately 1500 MHz.

4. The lens antenna array of claim 1, wherein the at least one antenna pair comprises a plurality of antenna pairs.

5. The lens antenna array of claim 1, wherein the patterned reinforcing material comprises a patterned aromatic polyester fiber.

6. The lens antenna array of claim 1, wherein the first adhesive layer and the second adhesive layer each comprise a bonding material.

7. The lens antenna array of claim 1, wherein the first outer layer, the second outer layer and the middle layer each have a thickness of approximately 0.0002 inches.

8. The lens antenna array of claim 1, wherein at least one of the first outer layer and the second outer layer comprises a metallization layer.

9. The lens antenna array of claim 1, wherein the transmit antenna is parallel to the ground plane.

10. The lens antenna array of claim 1, wherein the transmit antenna is parallel to the ground plane and to the receive antenna.

11. The lens antenna array of claim 1, wherein the third layered composite comprises an opening and the fourth layered composite extends through the opening.

12. The lens antenna array of claim 1, further comprising a phase shifter disposed along the balanced transmission line and on the fourth layered composite.

13. A stowable lens antenna array comprising:

at least one antenna pair comprising:

a transmit antenna on a first layered composite;

a receive antenna on a second layered composite;

a ground plane on a third layered composite, the ground plane being between and spaced apart from the transmit antenna and the receive antenna; and a balanced transmission line coupling the transmit antenna to the receive antenna, the balanced transmission line on a fourth layered composite; and an articulating structure attached to at least one of the first layered composite, the second layered composite and the third layered composite, the articulating structure having a collapsed configuration and an expanded configuration;

wherein at least one of the first layered composite, the second layered composite and the third layered composite comprises:

a first outer layer comprised of a polymeric film;

a second outer layer comprised of a polymeric film;

a middle layer disposed between the first outer layer and the second outer layer, the middle layer comprising a patterned reinforcing material;

a first adhesive layer disposed between the first outer layer and the middle layer; and a second adhesive layer disposed between the middle layer and the second outer layer.

14. The stowable lens antenna array of claim 13, wherein the transmit antenna and the receive antenna are components of a dipole antenna having a center operating frequency of approximately 1500 MHz.

15. The stowable lens antenna array of claim 13, wherein the at least one antenna pair comprises a plurality of antenna pairs.

16. The stowable lens antenna array of claim 13, wherein the articulating structure comprises a pantograph structure.

17. The stowable lens antenna array of claim 13, wherein the articulating structure comprises a jointed structure.

18. The stowable lens antenna array of claim 13, wherein the articulating structure comprises a pantograph structure and is configured to substantially flatten the at least one of the first layered composite, the second layered composite and the third layered composite in the expanded configuration.

19. A stowable lens antenna array comprising:

at least one antenna pair comprising:

a transmit antenna on a first layered composite;

a receive antenna on a second layered composite;

a ground plane on a third layered composite, the ground plane being between and spaced apart from the transmit antenna and the receive antenna; and a balanced transmission line coupling the transmit antenna to the receive antenna; and an articulating structure attached to at least one of the first layered composite, the second layered composite and the third layered composite, the articulating structure having a collapsed configuration and an expanded configuration;

wherein at least one of the first layered composite, the second layered composite and the third layered composite comprises:

a first outer layer comprised of a polymeric film;

a second outer layer comprised of a polymeric film;

a middle layer disposed between the first outer layer and the second outer layer, the middle layer comprising a patterned reinforcing material;

a first adhesive layer disposed between the first outer layer and the middle layer; and a second adhesive layer disposed between the middle layer and the second outer layer, and wherein each of the first layered composite, the second layered composite and the third layered composite comprise arcuate edges each having an elongated sleeve configured to receive a cable.

20. The stowable lens antenna array of claim 19, wherein each of the first layered composite, the second layered composite and the third layered composite comprise four arcuate edges.

21. The stowable lens antenna array of claim 19, wherein the articulating structure is configured to apply a tension to the cable making substantially flat each of the first layered composite, the second layered composite and the third layered composite in a deployed position.

22. The stowable lens antenna array of claim 21, wherein the first layered composite, the second layered composite and the third layered composite each form an approximately square shape in the deployed position.

23. The stowable lens antenna array of claim 21, wherein the articulating structure is configured to release the tension collapsing the stowable lens antenna array in a retracted position.

24. The stowable lens antenna array of claim 19, wherein the articulating structure is coupled to the cable at corners of each of the first layered composite, the second layered composite and the third layered composite.

25. The stowable lens antenna array of claim 19, wherein each of the arcuate edges comprises a catenary form.

* * * * *